US012083375B2

(12) United States Patent
Nalley

(10) Patent No.: US 12,083,375 B2
(45) Date of Patent: Sep. 10, 2024

(54) DUMBBELL WEIGHT TRAINING DEVICE WITH HIGH STRENGTH HANDLE ASSEMBLY

(71) Applicant: Mark Nalley, Murrieta, CA (US)

(72) Inventor: Mark Nalley, Murrieta, CA (US)

( * ) Notice: Subject to any disclaimer, the term of this patent is extended or adjusted under 35 U.S.C. 154(b) by 129 days.

(21) Appl. No.: 17/719,226

(22) Filed: Apr. 12, 2022

(65) Prior Publication Data

US 2023/0321474 A1 Oct. 12, 2023

(51) Int. Cl.
*A63B 21/072* (2006.01)
*A63B 21/00* (2006.01)
*A63B 21/075* (2006.01)

(52) U.S. Cl.
CPC ..... *A63B 21/0726* (2013.01); *A63B 21/0728* (2013.01); *A63B 21/075* (2013.01); *A63B 21/4035* (2015.10)

(58) Field of Classification Search
CPC ..... A63B 21/4035; A63B 21/072–075
See application file for complete search history.

(56) References Cited

U.S. PATENT DOCUMENTS 5,637,064 A * 6/1997 Olson ..... A63B 21/0728 482/107
6,416,446 B1 * 7/2002 Krull ..... A63B 21/0628 482/107
7,588,520 B2 9/2009 Nalley
8,075,458 B2 12/2011 Nalley
8,668,630 B2 * 3/2014 Towley, III ..... A63B 21/075 482/106
10,843,028 B2 11/2020 Nalley et al.
11,040,236 B1 * 6/2021 Chen ..... A63B 21/0728
11,229,819 B1 * 1/2022 Olson ..... A63B 21/0726
2003/0148862 A1 * 8/2003 Chen ..... A63B 21/0726 482/108
2006/0240958 A1 * 10/2006 Liu ..... A63B 21/0728 482/107
2007/0173386 A1 * 7/2007 Wang ..... A63B 21/0728 482/8
2009/0048079 A1 * 2/2009 Nalley ..... A63B 21/0728 482/107
2011/0028285 A1 * 2/2011 Towley, III ..... A63B 21/075 482/108

(Continued)

FOREIGN PATENT DOCUMENTS

CN 112451907 A * 3/2021 ..... A63B 21/075

*Primary Examiner* — Nyca T Nguyen
(74) *Attorney, Agent, or Firm* — Morland C. Fischer

(57) ABSTRACT

Disclosed is a dumbbell weight training device having a high strength handle assembly adapted to resist damage in the event that the dumbbell is dropped from high above the ground. The handle assembly includes first and opposite disc-shaped collars to which first and second stacks of weight plates are attached. A lifting handle to which a lifting three is applied and a pair of handle reinforcing rods extend in parallel alignment with e another between the first and opposite disc-shaped collars of the handle assembly. The lifting handle and the pair of handle reinforcing rods are arranged in a triangular configuration between the disc-shaped collars. When it is not in use, the dumbbell can be laid on and retained within a dumbbell storage tray having rests upon which the first and second stacks of weight plates and the first and opposite disc-shaped collars are seated.

18 Claims, 8 Drawing Sheets

(56) References Cited

U.S. PATENT DOCUMENTS

| | | | | |
|---|---|---|---|---|
| 2011/0092345 | A1* | 4/2011 | Svenberg | A63B 21/063 482/107 |
| 2011/0245048 | A1* | 10/2011 | Nalley | A63B 21/0615 482/107 |
| 2011/0312475 | A1* | 12/2011 | Towley, III | A63B 21/0726 482/107 |
| 2012/0264575 | A1* | 10/2012 | Towley, III | A63B 21/00065 482/107 |
| 2016/0361584 | A1* | 12/2016 | Towley | A63B 23/03575 |
| 2019/0299047 | A1* | 10/2019 | Nalley | A63B 21/0726 |
| 2019/0388723 | A1* | 12/2019 | Nalley | A63B 21/075 |
| 2021/0322817 | A1* | 10/2021 | Chen | A63B 21/0728 |

* cited by examiner

DUMBBELL WEIGHT TRAINING DEVICE WITH HIGH STRENGTH HANDLE ASSEMBLY

BACKGROUND OF THE INVENTION

1. Field of the Invention

This invention relates to a dumbbell of the kind commonly found in a fitness center to be used as a weight training device. The dumbbell is adapted to carry first and second stacks of weight plates that are detachably and selectively connected to one another and to opposite ends of a handle assembly. The handle assembly has a high strength structural configuration to reduce damage in the event that the dumbbell is dropped from high above the ground. When it is not being used, the dumbbell can be laid on and retained within a dumbbell storage tray.

2. Background Art

Dumbbells are weight training devices that have long been used by body builders and exercise conscious individuals to improve their physical strength as part of a weight training program. A conventional dumbbell typically includes a cylinder griping handle that carries one or more weights at each of the opposite ends thereof. On occasion, the dumbbell may be dropped during an exercise because its weight is too heavy to be lifted b an individual or the individual is careless when the dumbbell is suddenly lifted. In the case where a heavy dumbbell is dropped from high above the ground, the handle may be subjected to damage as a consequence of the outside edges of the weights falling and striking a hard surface. Accordingly, what would be desirably is an improved dumbbell having a high strength handle assembly that is configured to avoid damage when the dumbbell carries a heavy weight that is inadvertently dropped from high off the ground.

SUMMARY OF THE INVENTION

In general terms, an improved dumbbell is disclosed of the kind that is typically found at a fitness center for use as a weight training device. The improved dumbbell has a handle assembly including a cylindrical gripping handle and a round disc-shaped collar connected to each of the opposite ends of the handle. First and second stacks of weight plates are selectively and detachably coupled one to the other and to the disc-shaped collars of the handle assembly by means of a V-shaped coupler body being slidably and removably received within an opposing V-shaped coupling receptacle. The handle assembly is advantageously provided with a pair of handle reinforcing rods that extend in parallel alignment with each other and with the gripping handle between the disc-shaped collars located at the opposite ends of the gripping handle. The gripping handle and the pair of handle reinforcing rods are connected between the collars in an (e.g., equilateral) triangular configuration so as to reduce the impact force that is transmitted to the gripping handle and thereby avoid damage to the handle assembly if the dumbbell were to be inadvertently dropped from high above the ground.

A pair of add-on weight plates are provided to be removably attached to respective ones of the collars of the handle assembly of the dumbbell at V-shaped coupler bodies projecting therefrom. Each add-on weight plate has a smaller size and weight than the weight plates of the first and second stacks of weight plates that are detachably coupled to one another. The add-on weight plates permit the user to incrementally increase the weight to be lifted with the handle assembly of the dumbbell. Each of the disc-shaped add-on weight plates has a pair of legs that are separated from one another by a V-shaped opening that conforms to the V-shaped coupler bodies of the handle assembly.

A dumbbell storage tray is provided on which the dumbbell is laid while at rest. The dumbbell storage tray has a pair of sidewalls located at opposite ends thereof between which the first and second stacks of weight plates are retained. A pair of cylindrical weight plate rests extend between the pair of sidewalls upon which the first and second stacks of weight plates are seated. Each weight plate rest is surrounded by a pair of cradles upon which the disc-shaped collars of the handle assembly are laid. A pair of vertically extending pockets are formed in each of the sidewalk to receive therewithin the pair of legs from one of the pair of add-on weight plates so that the pair of add-on weight plates and the first and second stacks of weight plates can be held in place on the dumbbell storage tray until their use is required.

DESCRIPTION OF THE PREFERRED EMBODIMENT

Figure 1:
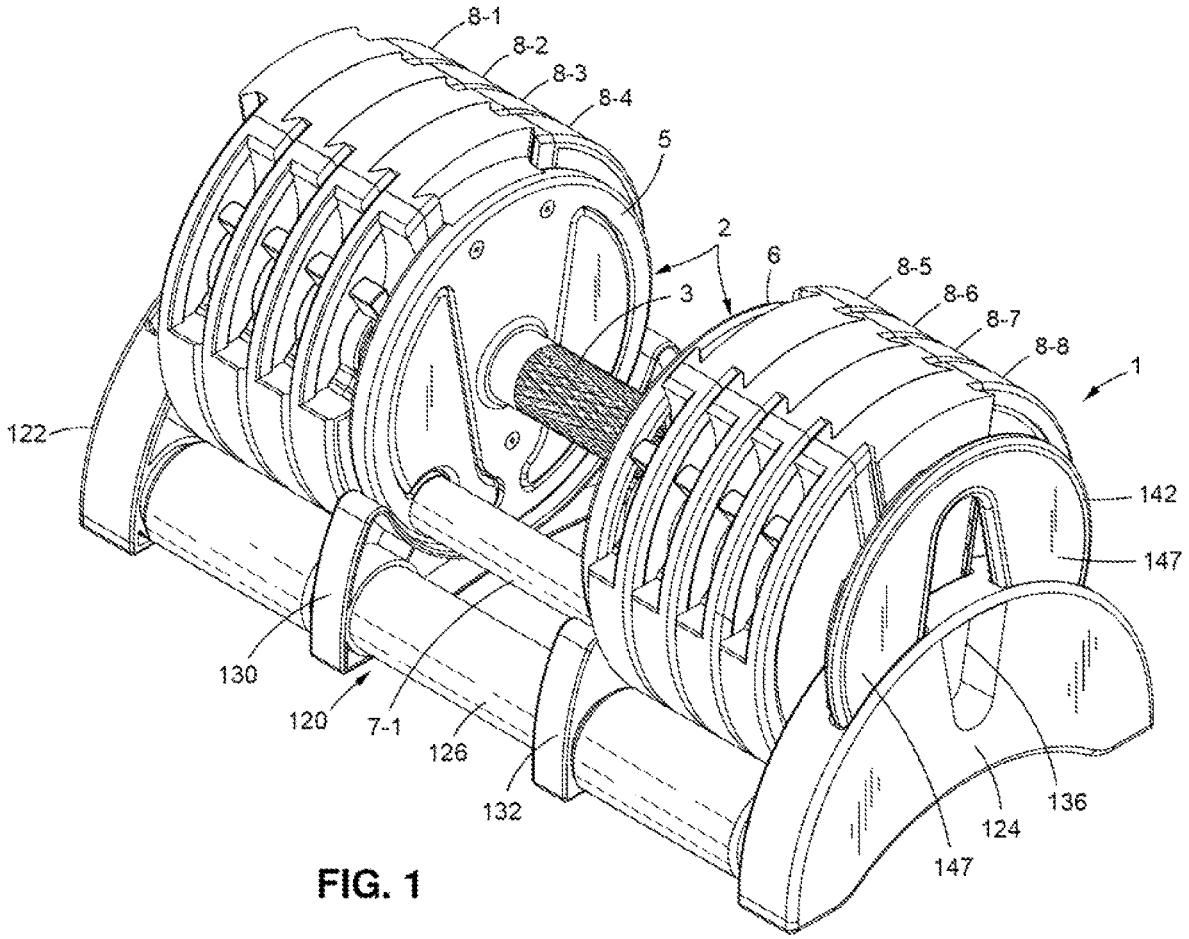
FIG. 1 shows an improved dumbbell being laid on a dumbbell storage tray when not in use and having first and second stacks of weight plates detachably and selectively coupled one to the other and to a pair of disc-shaped collars located at opposite ends of a handle assembly.

Referring initially to FIGS. 1-5 of the drawings, there is shown a dumbbell 1 of the type to be used as a personal exercise and weight training device. The dumbbell that is shown and disclosed will be typically found at a fitness center or at home to be repeatedly lifted by one seeking to improve his physical appearance, strength and conditioning. Although it is contemplated that the dumbbell 1 shown in FIGS. 1-5 will be grasped and lifted in a single hand of a user, the teachings of this invention are also applicable to both a kettlebell and to a barbell of the kind to be grabbed and lifted in both hands of a user. As will soon be disclosed, the dumbbell 1 is uniquely adapted to resist being damaged in the event it is accidentally dropped by a user from high above a hard surface during an exercise.

To this end, the improved dumbbell 1 has a high strength handle assembly 2 including a cylindrical gripping handle 3 (best shown in FIGS. 3-5) that extends between a pair of opposing round disc-shaped collars 5 and 6 at the centers thereof. The handle 3 of the handle assembly 2 is sized to be gripped within a single handle of a user. In the event that the teachings of this invention are applied to a barbell, the length of handle 3 will be extended to accommodate both hands of the user. As an important feature of this invention, and as is best shown in FIG. 4, a pair of handle reinforcing rods 7-1 and 7-2 extend between the pair of collars 5 and 6 of the handle assembly 2 between opposing outside edges thereof. A variable number of (e.g., identical weight plates designed 8-1 . . . 8-8 can be detachably connected to each other and to the collars 5 and 6 at opposite ends of the gripping handle 3 depending upon the experience of the user and the weight lifting exercise in which be will be engaged.

During use of the dumbbell 1, any number of a first stack consisting of half the total number of weight plates (e.g., 8-1 . . . 8-4) is coupled to one of the collars 5 and an identical number of a second stack consisting of the remaining number of weight plates (e.g., 8-5 . . . 8-8) is coupled to the other collar 6. By virtue of being able to vary the number of weight plates 8-1 . . . 8-8 to be carried by dumbbell 1 in a manner to be hereinafter described, the gross weight of the dumbbell can be selectively and incrementally changed so as to be tailored to conform to the weight training program of the user.

Each of the weight plates 8-1 . . . 8-8 is preferably cast from metal or plastic and has a generally round disc-like body with an ideal thickness of one inch. The weight plates 8-1 . . . 8-8 shown in FIGS. 1-3 ideally have an identical shape and weight. However, the precise number of weight plates to be carried by the dumbbell 1 as well as the particular weight and shape of each is a matter of personal choice as will be necessary to meet the needs of the individual during his or her weight lifting exercise.

Figure 4:
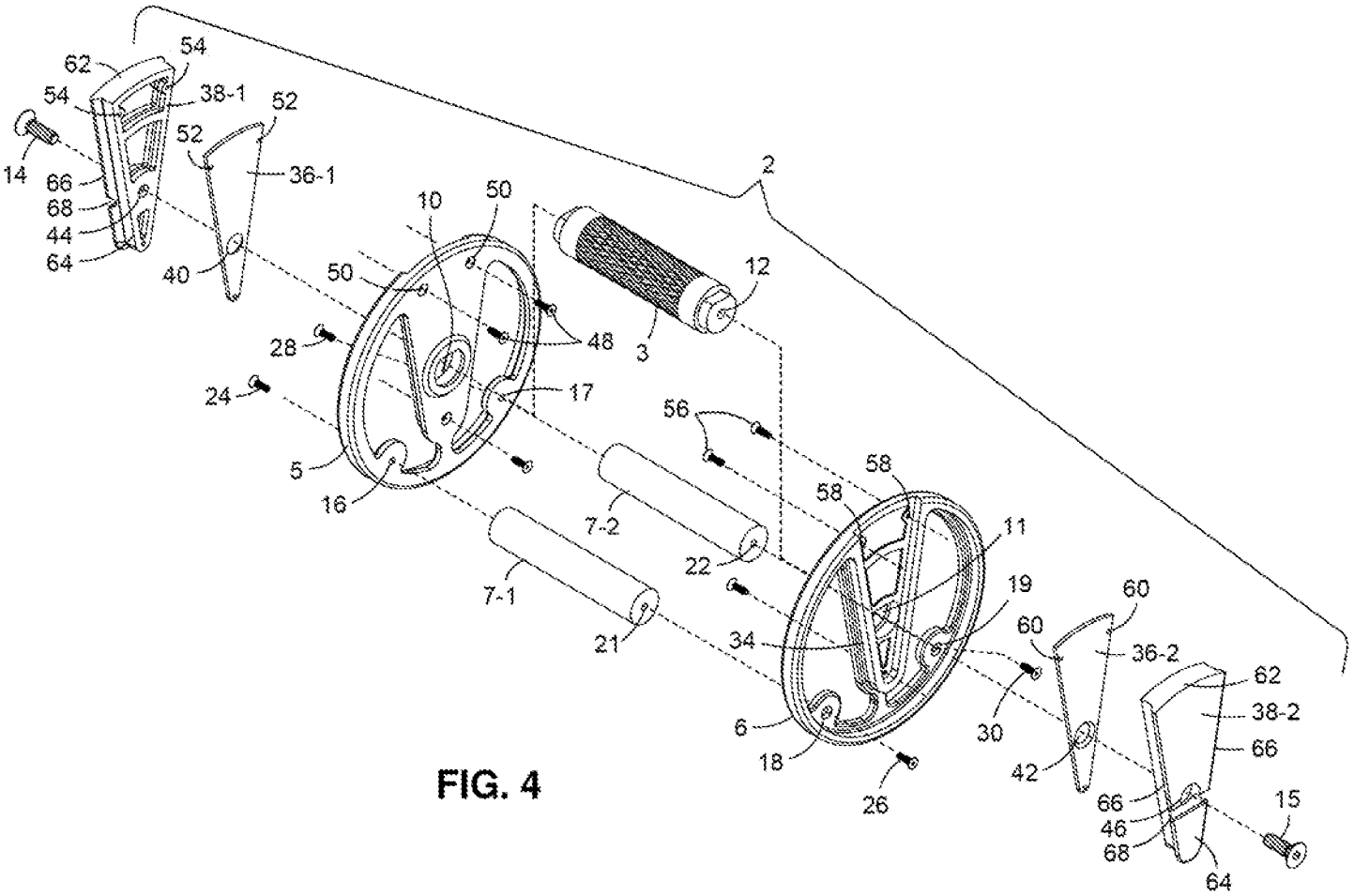
FIG. 4 is an exploded view of the handle assembly of the improved dumbell.
Figure 5:
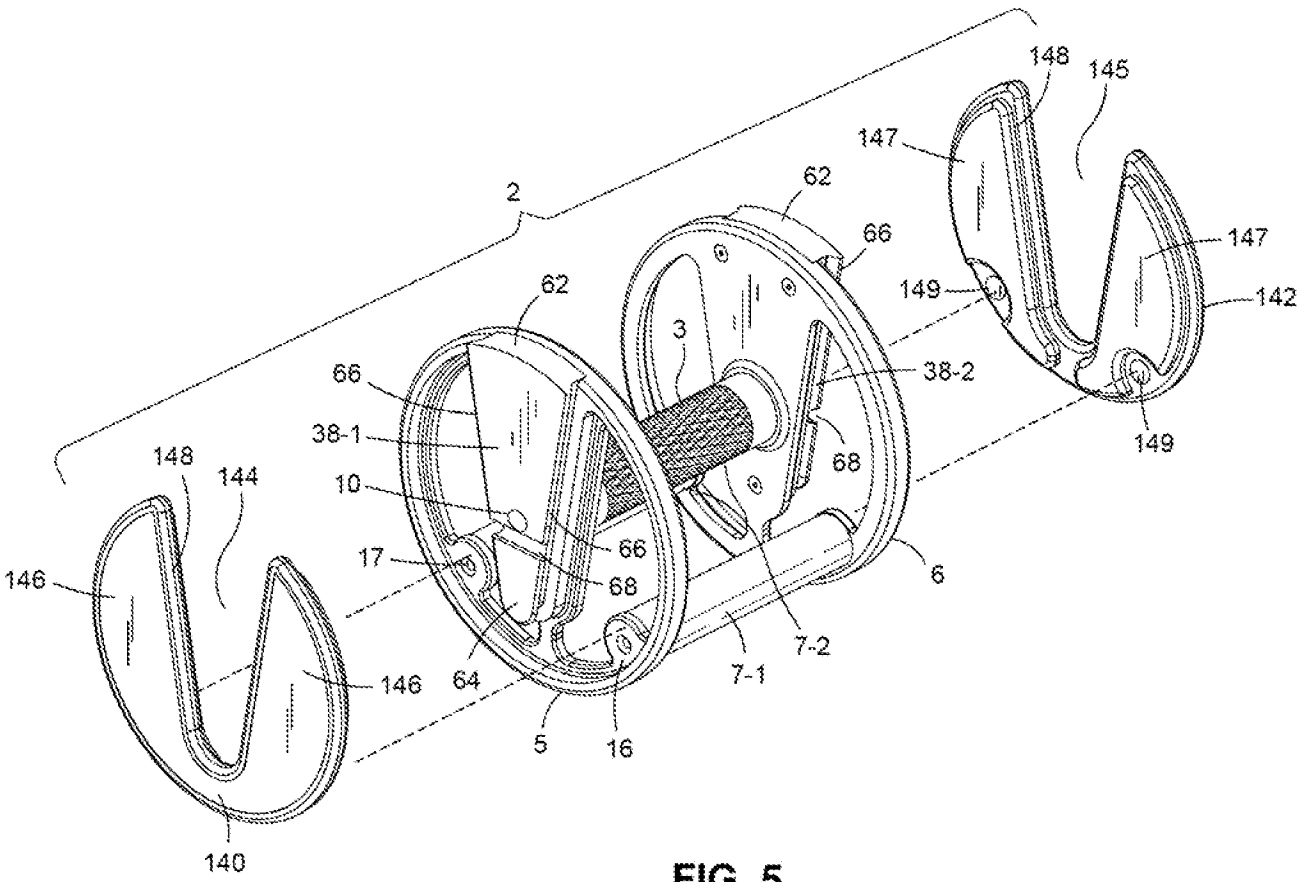
FIG. 5 is an exploded view of the handle assembly and a pair of add-on weight plates to be detachably coupled to the disc-shaped collars of the handle assembly.

FIGS. 4 and 5 show the high strength handle assembly 2 of the dumbbell 1 without any weight plates connected to the pair of collars 5 and 6 thereof. Each collar 5 and 6 is preferably round and manufactured from metal with a respective inner coupling hole 10 and 11 extending through the center thereof. The coupling holes 10 and 11 are sized and shaped to receive therewithin opposite ends of the cylindrical gripping handle 3. The gripping handle 3 has a threaded hole 12 running axially therethrough in which to receive first and second threaded fasteners 14 and 15 at opposite ends thereof by way of the inner coupling holes 10 and 11 of collars 5 and 6 for holding the handle 3 in place between the opposing pair of collars.

A first of the pair of disc-shaped collars 5 has a pair of outer rod reinforcing holes 16 and 17 formed therein and located at its circumference. The second of the collars 6 also has a pair of outer rods reinforcing holes 18 and 19 formed therein and located at its circumference. Each of the pair of handle reinforcing rods 7-1 and 7-2 has a respective threaded hole 21 and 22 running axially therethrough. A first threaded fastener 24 extends through the outer rod reinforcing hole 16 located at the circumference of the first collar 5 for receipt by one end of the threaded hole 21 that runs through the first handle reinforcing rod 7-1. A second threaded fastener 26 extends through the outer rod reinforcing hole 18 located at the circumference of the second collar 6 for receipt by the opposite end of the threaded hole 21 running through the first handle reinforcing rod 7-1, thereby to hold the first handle reinforcing rod 7-1 in place between the opposing pair of collars 5 and 6 of the handle assembly 2.

A third threaded fastener 28 extends through the outer rod reinforcing hole 17 located at the circumference of the first collar 5 for receipt by one end of the threaded hole 22 that runs through the second handle reinforcing rod 7-2. A fourth threaded fastener 30 extends through the outer rod reinforcing hole 19 located at the circumference of the second collar 6 for receipt by the opposite end of the threaded hole 22 running through the second handle reinforcing rod 7-2, whereby to hold the second handle reinforcing rod 7-2 in place between the opposing pair of collars 5 and 6 at the handle assembly 2.

FIG. 5 shows the assembled configuration of the handle assembly 2 of the dumbbell 1 with the gripping handle 3 and the pan of handle reinforcing rods 7-1 and 7-2 extending in parallel alignment with one another and connected between the opposing pair of collars 5 and 6. In this case, and as an important feature of the present invention, the gripping handle 3 located at the center and the pair of handle reinforcing rods 7-1 and 7-2 located at the outside edges i.e., circumference) of the pair of disc-like collars 5 and 6 are oriented in a triangular configuration. In particular, and as is best shown in FIG. 4, the inner coupling hole 10 and outer rod reinforcing holes 16 and 17 form the corners of a first equilateral triangle at the first collar 5, and inner coupling hole 11 and the outer rod reinforcing holes 18 and 19 form the corners of a second equilateral triangle at the second collar 6. What is more, the gripping handle 3 and the handle reinforcing rods 7-1 and 7-2 are all detachable from the handle assembly 2 independently of one another.

By virtue of the aforementioned triangular orientation of the handle assembly 3 and the pair of parallel aligned handle reinforcing rods 7-1 and 7-2 extending between the opposing collars 5 and 6, the handle assembly 2 is provided with an enhanced structurally reinforced configuration compared with existing handle assemblies found in conventional dumbbells. That is, the impact forces that would normally be applied directly to the gripping handle 3 are deflected away from the gripping handle by the handle reinforcing rods 7-1 and 7-2, whereby the handle assembly 2 of dumbbell 1 will be better able to resist fracture and collapse in the event that the collars 5 and 6 are inadvertently dropped on their edges and fall from high above the ground against a hard surface by a user during a weight lifting exercise.

As is best shown in FIG. 4, the outside face of each of the pair of collars 5 and 6 has a V-shaped coupler receptacle 34 running diagonally thereacross. The diagonally extending V-shaped coupler receptacle 34 of each disc-like collar 6 is located midway between the outer rod reinforcing holes (e.g., 18 and 19) to which the handle reinforcing rods 7-1 and 7-2 are connected at the circumference of the collar 6. The coupler receptacles 34 are configured to receive therewithin a respective V-shaped insert 36-1 and 36-2 and a V-shaped coupler body 38-1 and 38-2. Each of the inserts 36-1 and 36-2 has a mounting hole 40 and 42 formed therethrough, and each of the coupling bodies 38-1 and 38-2 also has a mounting hole 44 and 46 formed therethrough.

The insert 36-1 and the coupler body 38-1 are held one above the other within the coupler receptacle (not shown) of the first collar 5 by means of the aforementioned first threaded fastener 14 passing through the mounting holes 44 and 40 and the coupling hole 10 at the center of the first collar 5 for receipt by the first end of the gripping handle 3. The insert 36-2 and the coupler body 38-2 are held one above the other within the coupler receptacle 34 of the second collar 6 by means of the aforementioned second threaded fastener 15 passing through the mounting holes 46 and 42 and the coupling hole 11 at the center of the second collar 6 for receipt by the opposite end of the gripping handle 3. The inserts 36 provide stability to and limit the movement of the coupling bodies 38-1 and 38-2 within their coupler receptacles 34.

To further stabilize the V-shaped coupler bodies 38-1 and 38-2 shown in FIG. 4 within their respective V-shaped coupler receptacles 34, a first pair of threaded fasteners 48 pass through a corresponding first pair of holes 50 that are formed through the top of the first disc-shaped collar 5 and a first pair of holes 52 that are formed through the top of the insert 36-1. The first pair of fasteners 48 are ultimately received by an axially aligned pair of threaded holes 54 that are formed in the top of the coupler body 38-1. Likewise, a second pair of threaded fasteners 56 pass through a corresponding second pair of holes 58 that are formed through the top of the second disc-like collar 6 and a second pair of holes 60 that are formed through the top of the insert 36-2. The second pair of fasteners 56 are ultimately received by an axially aligned pair of threaded holes (not shown) that are formed in the top of the coupler body 38-2.

Each V-shaped coupler body 38-1 and 38-2 that is attached to one of the collars 5 and 6 of the handle assembly 2 is tapered so as to have a relatively wide head 62 that lies on the circumference at the top of a corresponding one of the collars 5 and 6 and a relatively narrow tail 64 that lies diagonally inward from the head 62 adjacent the circumference at the bottom of the collar. A guide rail 66 runs along each of the opposite sides of the tapered V-shaped coupler bodies 38-1 and 38-2. A locking pin extension channel 68 runs laterally across each of the coupling bodies 38-1 and 38-2 so as to lie between the relatively wide head 62 and the relatively narrow tail 64 thereof.

To reduce the weight of the handle assembly 2 of the dumbbell 1, the area of each disc-shaped collar 5 and 6 is empty between the V-shaped receptacle 34 and the circumference thereof. However, as will be explained whets referring to FIG. 5, the weight of the handle assembly 2 can be increased by attaching add-on weight plates 140 and 142 to the outside face of each of the collars 5 and 6.

Figure 6:
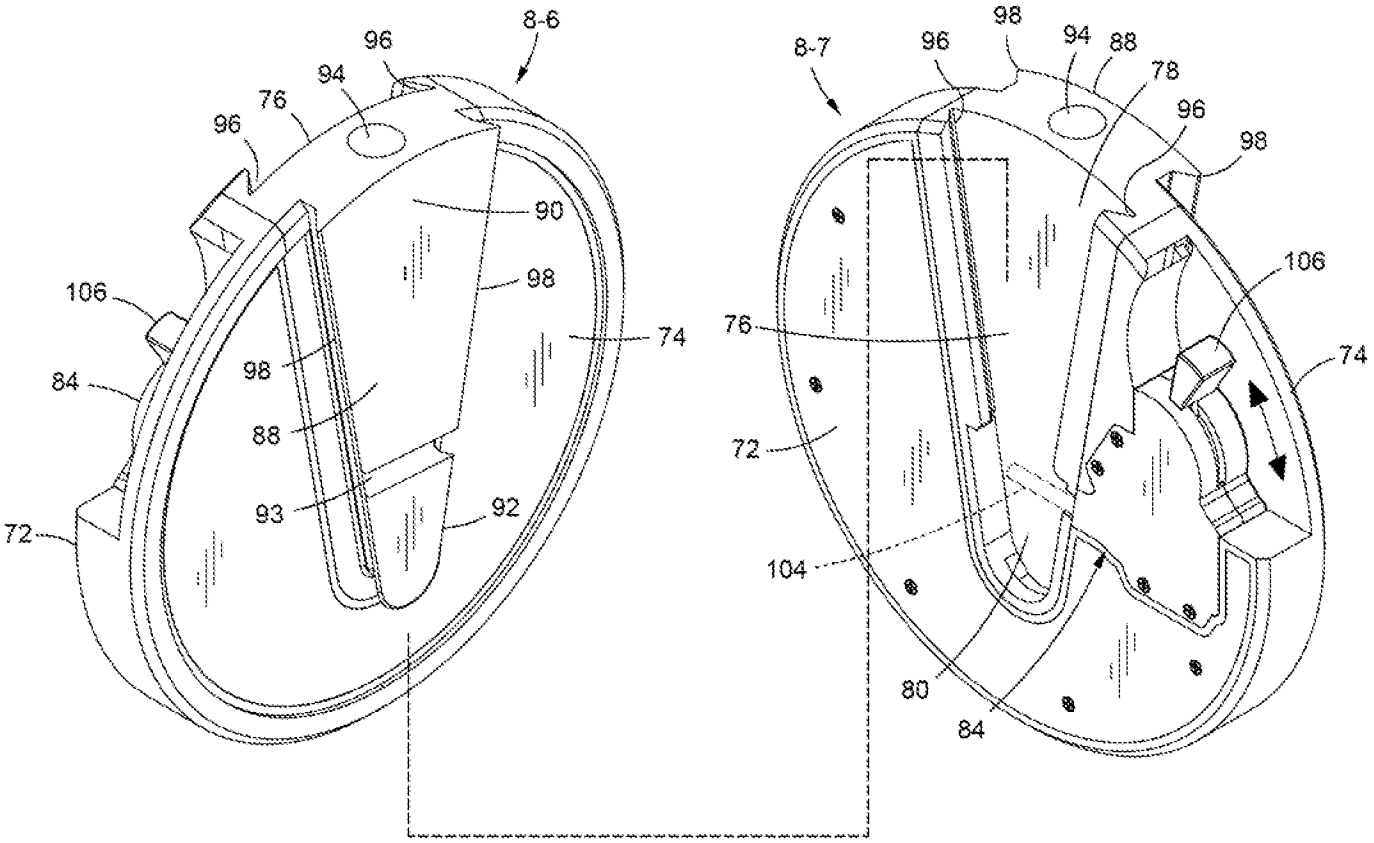
FIG. 6 shows a pair of weight plates from one of the first or second stacks of weight plates of the dumbbell to be detachably and selectively coupled one to the other.
Figure 7:
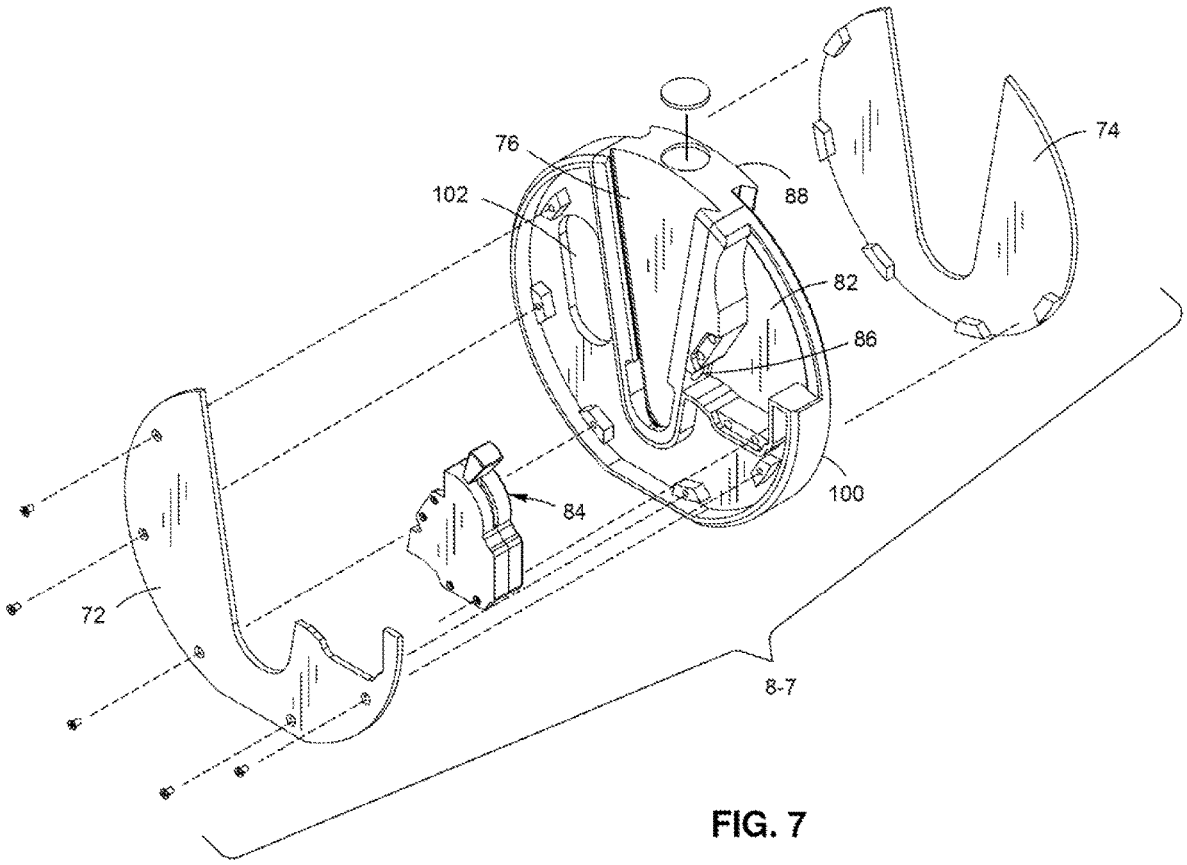
FIG. 7 is a left side exploded view of one of the pair of weight plates show its FIG. 6.
Figure 8:
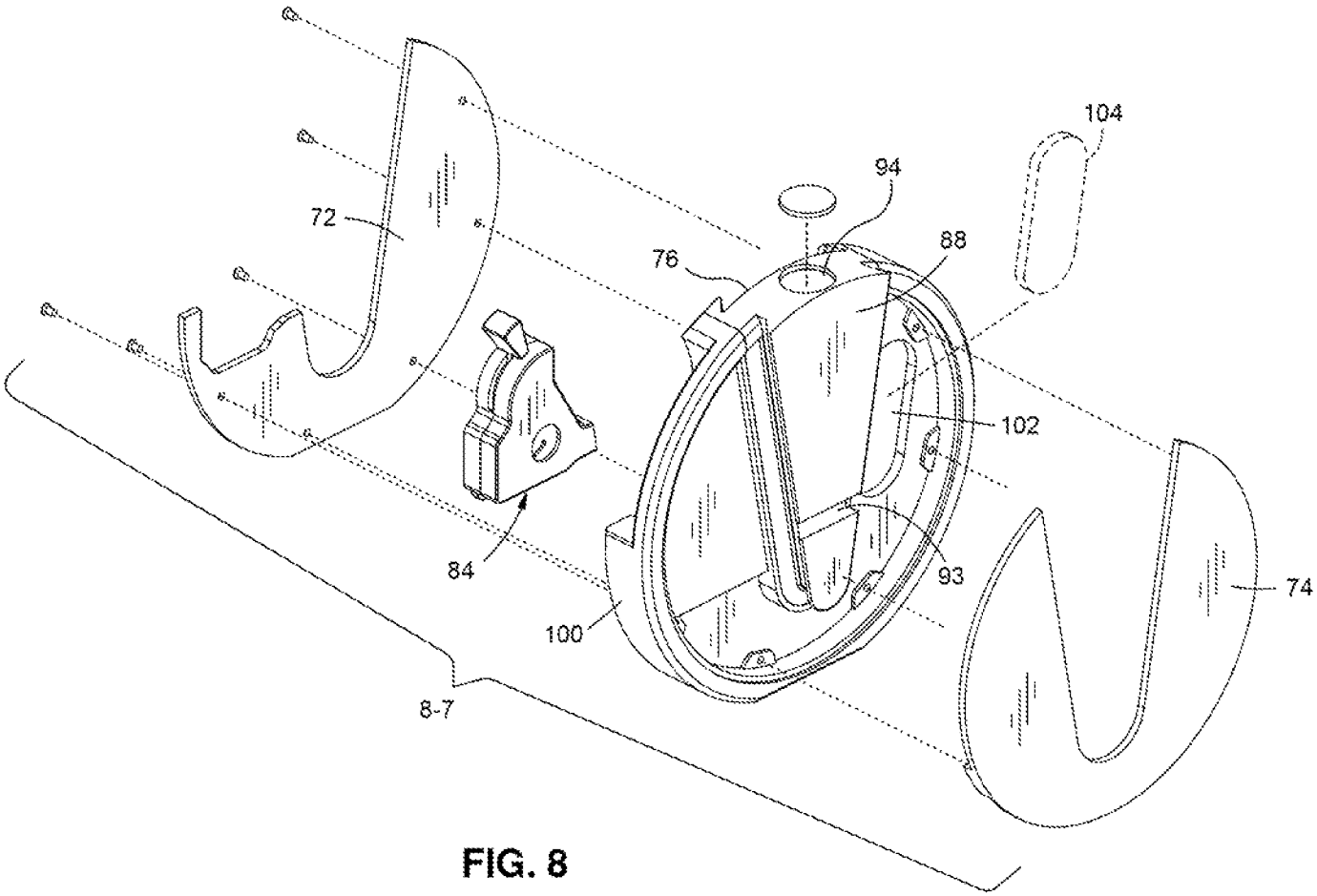
FIG. 8 is a right side exploded view of the weight plate shown in FIG. 7.

Details of the identical disc-like weight plates (designated 8-1 . . . 8-8 in FIG. 2) to be selectively and detachably connected to each other and to one or the other of the collars 5 and 6 at opposite ends of the gripping handle 3 of the dumbbell 1 are now described while referring to FIGS. 6-8 of the drawings. Each of the weight plates (e.g., 8-6 and 8-7) includes opposing inside and outside faces 72 and 74. A tapered and generally V-shaped coupling receptacle 76 is recessed into the inside face 72 of each weight plate. The V-shaped coupling receptacle 76 has a relatively wide head 78 that lies on the circumference at the top of the disc-shaped weight plate 8-7 and a relatively narrow tail 80 that lies diagonally inward from the head 78. A locking cartridge cavity 82 (best shown in FIGS. 7 and 8) is formed in the weight plate 8-7 between the inside and outside faces 72 and 74 thereof to receive a locking cartridge 84 therewithin. A locking pin receiving opening 86 extends between the locking cartridge 84 and the V-shaped coupling receptacle 76.

A diagonally extending and tapered V-shaped coupling body 88 (best shown in FIG. 6) that is preferably manufactured by means of a plastic injection forming process projects outwardly from the outside face 74 of weight plate 8-7 so as to lie opposite the coupling receptacle 76 that is recessed within the inside face 72. The V-shaped coupling body 88 of the weight plate 8-7 has a size and shape that match the size and shape of the opposing coupling receptacle 76 as well as the V-shaped coupler bodies 38-1 and 38-2 (of FIGS. 3-5) which project outwardly from the collars 5 and 6 that are connected to opposite ends of the gripping handle 3 of handle assembly 2. Like the V-shaped coupling receptacle 76 at the inside face 72 of weight plate 8-7, the V-shaped coupling body 88 at the outside face 74 of the disc-shaped weight plate 8-6 has a relatively wide head 90 that lies on the circumference at the top of the weight plate 8-6 and a relatively narrow tail 92 that lies diagonally inward from the head 90. A locking pin receiving channel 93 runs laterally across the tail 92 of coupling body 88 for a purpose that will soon be explained. A mounting hole 94 is formed through the head 90 at the top of the coupling body 88 in which to receive an indicator plug shown in FIGS. 7 and 8 to visually designate the weight of the weight plate.

Figure 2:
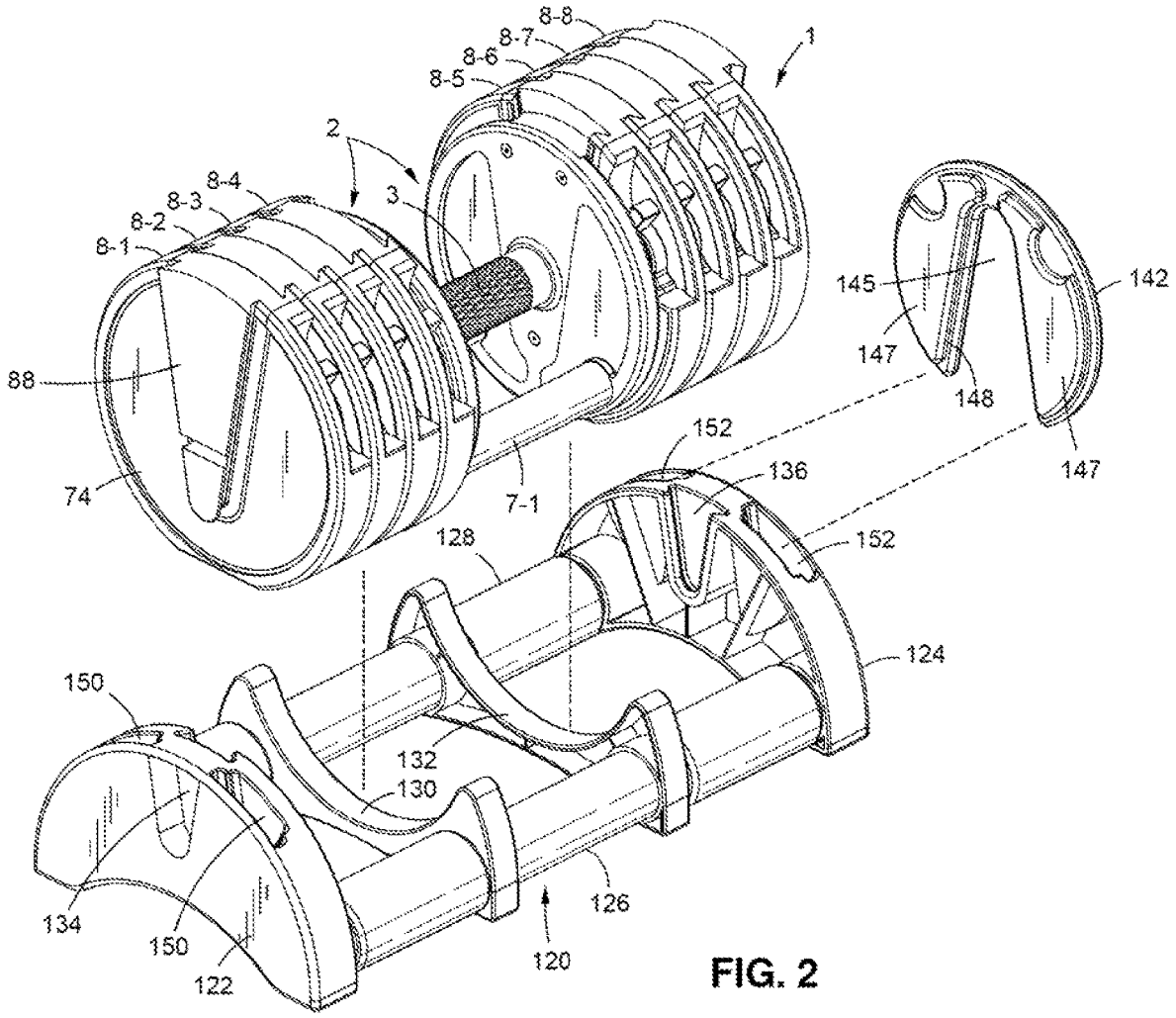
FIG. 2 is an exploded view showing the improved dumbbell of FIG. 1 separated from the dumbbell storage tray.
Figure 3:
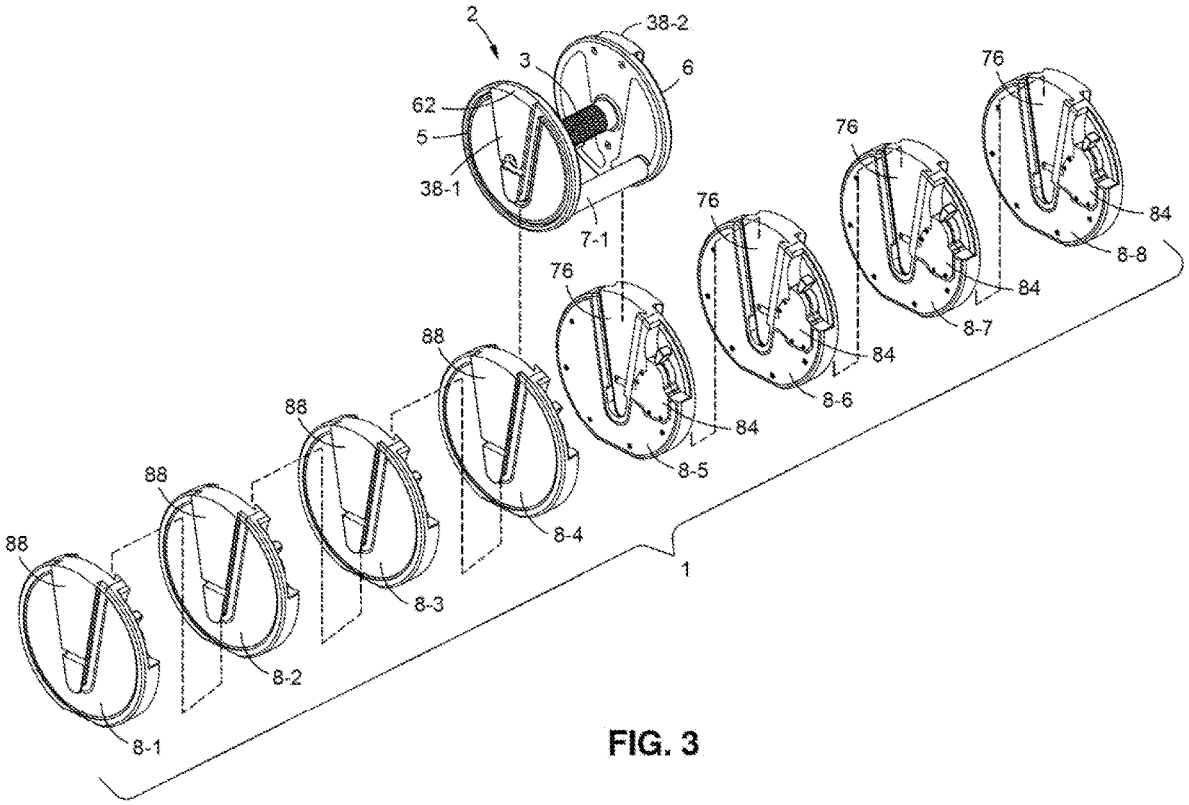
FIG. 3 is an exploded view showing the first and second stacks of weight plates separated from one another and from the handle assembly.

The recessed V-shaped coupling receptacles 76 and the outwardly projecting V-shaped coupling bodies 88 at the opposite inside and outside faces 72 and 74 of each of the weight plate 8-1 . . . 8-8 of FIGS. 1-3 are sized and shaped relative to each other so that the coupling body 88 at the outside face 74 of any one weight plate (e.g., 8-6) is slidable downwardly to be received by and mated to the coupling receptacle 76 at the inside face 72 of an adjacent weight plate (e.g., 8-7), whereby the pair of adjacent weight plates 8-6 and 8-7 are detachably connected face-to-face one another to be lifted together by the dumbbell 1. To facilitate the sliding connection and mating engagement of a coupling body 8 to a coupling receptacle 76 so that adjacent weight plates are held face-to-face, locking grooves 96 are formed along the opposite sides of each V-shaped coupling receptacle 76 within which to slidably receive and releasably capture respective guide rails 98 that run along opposite sides of each V-shaped coupling body 88. The slidable and mating engagement of a coupling body 88 and the guide rails 98 thereof from one weight plate 8-6 to a coupling receptacle 76 and the locking grooves 96 of an adjacent weight plate 8-7 is commonly referred to as a male/female dove-tail connection.

In this same regard, weight plates (e.g., designated 8-4 and 8-5 in FIGS. 1-3) from each of the aforementioned first and second stacks of weight plates are detachably connected to respective ones of the collars 5 and 6 that are connected to opposite ends of the gripping handle 3 of the handle assembly 2. That is, the V-shaped coupler bodies 38-1 and 38-2 that project outwardly from the collars 5 and 6 are slidable downwardly towards and removably received by the V-shaped coupling receptacles 76 that are recessed into the inside faces 72 of weight plates 8-4 and 8-5. By virtue of the guide rails 66 (of FIG. 5) that run along the sides of the coupler bodies 38-1 and 38-2 of the collars 5 and 6 and the locking grooves 96 (of FIG. 6) that run along the sides of the coupling receptacles 76 of the weight plates 8-4 and 8-5, the coupler bodies 38-1 and 38-2 are coupled to the coupling receptacles 76 by means of an identical dove-tail connection as described above.

Referring briefly to FIGS. 7 and 8 of the drawings, an exploded view of one off the plurality of weight plates (e.g., 8-7) is shown having a metal (e.g., steel) core 100 including, the aforementioned locking cartridge cavity 82 formed therein in which to receive a locking cartridge 84. The core 100 of weight plate 8-7 is preferably disc-shaped and manufactured with a filler hole 102 formed therein. The presence of one or more filler holes (e.g., 102) in the core 100 enables the weight of the weight plate 8-7 to be controlled. That is, to be able to provide a variety of weight plates having different weights without having to change the physical dimensions and ballast of each weight plate, the filler hole 102 may be filled with a plug (designated 104 in FIG. 8) to increase the weight of the weight plate. The plug 104 can be manufactured from metal or any other compatible material by which to vary the weight from one weight plate to another and thereby provide a user with a variety of weights available from weight plates of identical size.

FIGS. 7 and 8 also show an option where the inside and outside faces 72 and 74 of each weight plate (e.g., 8-7) can be attached by means of fasteners or adhesive to opposite sides of the core 100. In this example, the inside face 72 and the outside face 74 are anterior and posterior shrouds that Cover the interior of the core 100 and provide a flat surface on which indicia can be written for the purpose of instruction or advertising. The anterior and posterior shroud faces 72 and 74 contain V-shaped openings that conform to the V-shaped coupling receptacle 76 and the V-shaped coupling body 88 of the core 100 of weight plate 8-7.

As is best shown in FIGS. 3 and 6, each of the weight plates 8-1 . . . 8-8 of the dumbbell 1 has a locking cartridge 84 that is operable for causing a first weight plate (e.g., designated 8-6 in FIG. 6) to be detachably and selectively connected to an additional (i.e., adjacent) weight plate (e.g., designated 8-7 in FIG. 6) so that both weight plates 8-6 and 8-7 can be carried by the dumbbell and lifted together along with any other newly added weight plates as is necessary to suit the exercise requirements of the user. Any number of locking cartridges may be operated one at a time by the user depending upon the number of weight plates to be added to the dumbbell 1 and lifted during an exercise.

The locking cartridges 84 of weight plates 8-1 . . . 8-8 can be identical to the locking cartridge that is shown and described in my U.S. Pat. No. 7,588,520 issued Sep. 15, 2009, the details of which are incorporated herein by reference. Briefly, however, each locking cartridge 84 includes a locking pin (designated 104 in FIG. 6) that is adapted to be pushed or pulled by means of a reciprocating switch control knob 106 between a retracted position located inwardly of the locking cartridge 84 and an axially extended position at which to move outwardly from the locking cartridge 84 of weight plate 8-6 and into the coupling receptacle 76 formed in the inside face 72 of the adjacent weight plate 8-7 by way of the locking pin receiving opening 86 of FIG. 7 lying therebetween.

In particular, when the switch control knob 106 is pulled in a first direction, the locking pin 104 is correspondingly pushed to its axially extended position at which to ride through the locking pin receiving channel 93 in the coupling body 88 of the weight plate 8-6 that is removably received within the coupling receptacle 76 of weight plate 8-7. Accordingly, the coupling body 88 is held in place within the coupling receptacle 76 by locking pin 104 so that the adjacent weight plates 8-6 and 8-7 are detachably coupled one to the other to be lifted together. It may be appreciated that all of the weight plates 8-1 . . . 8-8 of FIG. 3 may be similarly coupled together and to the collars 5 and 6 of handle assembly 2 without a coupling rod running longitudinally therethrough.

Referring once again to FIGS. 1 and 2, there is shown a dumbbell storage tray 120 to be laid upon a flat surface within which to receive the dumbbell 1 having the handle assembly 2 located between and coupled to the stacks of weight plates 8-1 . . . 8-4 and 8-5 . . . 8-8 that are shown in FIG. 3. That is, a first stack of weight plates 8-1, . . . 8-4 is coupled to the collar 5 at one side of the handle assembly 2, and a second stack of weight plates 8-5 . . . 8-8 is coupled to the collar 6 at the opposite side of the handle assembly 2.

The dumbbell storage tray 120 includes a pair of sidewalls 122 and 124 located at opposite sides thereof between which the dumbbell 1 is received when its use is not required. A pair of tubular weight plate rests 126 and 128 extended between the sidewalk 122 and 124 upon which the first and second stacks of weight plates 8-1 . . . 8-4 and 8-5 . . . 8-8 are seated when the dumbbell 1 is at rest. Each of the pair of tubular weight plate rests 126 and 128 is surrounded by one end of a pair of arcuate cradles 130 and 132 that are arranged in spaced parallel alignment with one another and positioned to lie underneath the disc-like collars 5 and 6 of handle assembly 2. When the dumbbell 1 is placed within the dumbbell storage tray 120 and the weight plates 8-1 . . . 8-8 are seated on the weight plate rests 126 and 128, the collars 5 and 6 are simultaneously seated within and supported by the cradles 130 and 132.

As is best shown in FIG. 2, a vertical slot 134 and 136 runs downwardly through each of the sidewalls 122 and 124 of the dumbbell storage tray 120. The vertical slots 134 and 136 are configured to slidably receive therewithin respective V-shaped coupling bodies 88 from the first 8-1 and the last 8-8 of the weight plates 8-1 . . . 8-8 to thereby stabilize and hold the dumbbell 1 in place within dumbbell tray 120.

As is best shown in FIG. 5, a pair of optional add-on weight plates 140 and 142 can be removably attached to the disc-shaped collars 5 and 6 of the handle assembly 2. The add-on weight plates 140 and 142 are ideally of smaller size and lighter weight that the remainder of the weight plates 8-1 . . . 8-8 to be carried by the dumbbell 1. By way of example only, if each weight plate 8-1 . . . 8-8 is 5 pounds, each add-on weight plate 140 and 142 may be 1 pound. By virtue of the foregoing, the user can increase the weight to be lifted by a small increment that is less than the weight of a fully sized weight plate so as to tailor his or her exercise needs.

Each add-on weight plate 140 and 142 preferably has a disc shape with a V-shaped opening 144 and 145 formed therein and running downwardly from the circumference at the top thereof and diagonally between respective pairs of legs 146 and 147. However, a weight plate configuration can be used other than one having the aforementioned pairs of legs 146 and 147. The V-shaped openings 144 and 145 are sized and configured to match the size and shape of the V-shaped coupler bodies 38-1 and 38-2 which project from the collars 5 and 6 of the handle assembly 2. Accordingly, as best shown in FIG. 5, the weight to be lifted with the handle assembly 2 can be increased by mounting the add-on weight plates 140 and 142 on the collars 5 and 6 of the handle assembly 2. In this case, the V-shaped coupler bodies 38-1 and 38-2 that project from collars 5 and 6 are slidably received through the V-shaped openings 144 and 145 such that the add-on weight plates 140 and 142 lay on the collars 5 and 6 and cover the open areas formed therein. A mating channel 148 runs around the periphery of each V-shaped opening 144 and 145 of each add-on weight plate 140 and 142 so as to slide under and along the guide rail (designated 66 in FIG. 5) that runs around each coupler body 38-1 and 38-2. Magnets 149 or snap-on fasteners recessed within the add-on weight plates 140 and 142 hold the weight plates in place against collars 5 and 6 of the handle assembly 2.

As is best shown in FIG. 2, each sidewall 122 and 124 of the dumbbell storage tray 120 has a pair of pockets 150 and 152 formed side-by-side therein. The vertical slot 134 running downwardly through a first sidewall 122 lies between the pair of pockets 150, and the vertical slot 136 running downwardly through the opposite sidewall 124 lies between the pair of pockets 152. As is best shown in FIG. 1, the pairs of pockets 150 and 152 in sidewalls 122 and 124 are sized to receive downwardly therewithin respective pairs of legs (e.g., 147) of the add-on weight plates (e.g., 142). Accordingly, the add-on weight plates 140 and 142 may be conveniently held in place with the handle assembly 2 and the weight plates 8-1 . . . 8-8 of the dumbbell 1 on the storage tray 120.

The invention claimed is:

1. A dumbbell for use during a weight lifting exercise, said dumbbell comprising:

a handle assembly having first and opposite sides and a gripping handle extending between said first and opposite sides at which said dumbbell is grasped and lifted;

a first number of weight plates to be coupled to said handle assembly at the first side thereof and lifted by the dumbbell in response to a lifting force applied to said gripping handle; and a second number of weight plates to be coupled to said handle assembly at the opposite side thereof to be lifted by said dumbbell with the first number of weight plates in response to the lifting force applied to said gripping handle, said handle assembly also having at least a first handle reinforcing rod extending between the first and opposite sides of said handle assembly with said gripping handle, each of the first and opposite sides of said handle assembly having a coupler body projecting therefrom and each of said first and second numbers of weight plates including a first weight plate having a coupling receptacle formed therein, the coupler bodies of the first and opposite sides of said handle assembly being removably received within respective ones of the coupling receptacles of the first weight plate of said first and second numbers of weight plates, whereby said first weight plates are coupled to said handle assembly to be lifted together, and each weight plate of said first and second numbers of weight plates including an intermediate core having first and opposite faces, a flat anterior cover lying over said first face and a flat posterior cover lying over said opposite face, each of the flat anterior covers of said first weight plates having an opening through which the coupler bodies that project from the first and opposite sides of said handle assembly are received by respective ones of the coupling receptacles of said first weight plates.

2. The dumbbell recited in claim 1, said handle assembly also having a second handle reinforcing rod extending between the first and opposite sides of said handle assembly with said gripping handle and said first handle reinforcing rod.

3. The dumbbell recited in claim 2, wherein the gripping handle and the first and second handle reinforcing rods of said handle assembly extend in parallel alignment with one another between the first and opposite sides of said handle assembly.

4. The dumbbell recited in claim 3, wherein the gripping handle and the first and second handle reinforcing rods of said handle assembly are arranged with one another in a triangular configuration between the first and opposite sides of said handle assembly.

5. The dumbbell recited in claim 4, wherein the gripping handle and the first and second handle reinforcing rods of said handle assembly are arranged with one another in an equilateral triangular configuration.

6. The dumbbell recited in claim 4, wherein the first and opposite sides of said handle assembly are first and opposite round collars, each of which having a center and a circumference surrounding the center, the gipping handle of said handle assembly extending between the respective centers of said first and opposite round collars, and the first and second handle reinforcing rods of said handle assembly extending between points on the respective circumference of said first and opposite round collars.

7. The dumbbell recited in claim 1, wherein each of the couplers projecting from the first and opposite sides of said handle assembly and each of the receptables formed in the first weight plate of each of said first and second numbers of weight plates has a V-shape.

8. The dumbbell recited in claim 1, wherein each of the first and second numbers of weight plates also has a second weight plate to be coupled to the first weight plate from respective ones of said first and second numbers of weight plates, said first and second weight plates having a different size and a different weight relative to one another.

9. The dumbbell recited in claim 1, wherein said coupler bodies are detachably connected to the first and opposite sides of said handle assembly.

10. The dumbbell recited in claim 1, wherein each first weight plate of each of said first and second numbers of weight plates has a locking housing including a locking pin and a switch knob communicating with said locking pin and being operable to cause said locking pin to move between a retracted position located inwardly of said locking housing and an extended position located outwardly from said locking housing and into locking engagement with the coupler body projecting from a respective one of the first and opposite sides of said handle assembly, whereby said first weight plates are coupled to said handle assembly.

11. The dumbbell recited in claim 1, wherein the intermediate core of the first weight plate of each of said first and second numbers of weight plates has a filler hole formed therein such that each of said first weight plates has a first weight, said dumbbell also comprising filler plugs to be located within respective ones of said filler holes, whereby said first weight plates have a heavier weight.

12. The dumbbell recited in claim 1, wherein each first weight plate of said first and second numbers of weight plates has a coupling body projecting therefrom, and the flat posterior cover of each first weight plate has an opening formed therein for the receipt of said coupling body therethrough.

13. A combination comprising:

a dumbbell for use during a weight lifting exercise, said dumbbell comprising:

a handle assembly having first and opposite sides and a gripping handle extending between said first and opposite sides at which said dumbbell is grasped and lifted;

a first plurality of weight plates to be coupled to said handle assembly at the first side thereof and lifted by the dumbbell in response to a lifting force applied to said gripping handle;

a second plurality of weight plates to be coupled to said handle assembly at the opposite side thereof to be lifted by said dumbbell with the first plurality of weight plates in response to the lifting force applied to said gripping handle;

a dumbbell storage tray within which said dumbbell is laid when not in use, said dumbbell storage tray having first and opposite sidewalls between which said dumbbell is located, each of the first and opposite sidewalls of said dumbbell storage tray having a vertical slot formed therein, one weight plate of said first plurality of weight plates of said dumbbell having a coupler to be removably received within the vertical slot formed in said first sidewall, and one weight plate of said second plurality of weight plates of said dumbbell having a coupler to be removably received within the vertical slot formed in said opposite sidewall, whereby said first and second pluralities of weight plates are coupled to the first and opposite sidewalls of said dumbbell storage tray; and at least one add-on weight plate to be coupled to one of said first or second pluralities of weight plates, one of the first or opposite sidewalls of said dumbbell storage tray having a pocket formed therein within which to removably receive said at least one add-on weight plate.

14. The combination recited in claim 13, wherein said dumbbell storage tray has at least one weight plate rest extending between the first and opposite sidewalls therof; the first and second pluralities of weight plates of said dumbbell being seated on said weight plate rest.

15. The combination recited in claim 14, wherein said dumbbell storage tray also has a pair of handle assembly cradles attached to said at least one weight plate rest, the first and opposite sides of said handle assembly being seated within respective ones of said pair of handle assembly cradles.

16. The combination recited in claim 13, wherein the at least one add-on weight plate to be coupled to the one of said first or second pluralities of weight plates has a pair of legs that are spaced from one another by a cut-out, said pair of legs being removably received within said pocket.

17. The combination recited in claim 16, wherein the pocket formed in the one of said first or opposite sidewalls of said dumbbell storage tray has a pair of pocket cavities aligned side-by-side one another within which to removable receive respective ones of the pair of legs of said add-on weight plate.

18. A dumbbell for use during a weight lifting exercise, said dumbbell comprising:

a handle assembly having first and opposite sides and a gripping handle extending between the respective centers of said first and opposite sides at which said dumbbell is grasped and lifted;

a first number of weight plates to be coupled to said handle assembly at the first side thereof and lifted by the dumbbell in response to a lifting force applied to said gripping handle; and a second number of weight plates to be coupled to said handle assembly at the opposite side thereof to be lifted by said dumbbell with the first number of weight plates in response to the lifting force applied to said gripping handle, said handle assembly also having at least a first handle reinforcing rod and a second handle reinforcing rod extending between the first and opposite sides of said handle assembly, wherein the gripping handle and the first and second handle reinforcing rods of said handle assembly extend in parallel alignment with one another between the first and opposite sides of said handle assembly such that the gripping handle and the first and second handle reinforcing rods of said handle assembly are arranged with one another in an equilateral triangular configuration.

* * * * *